US009290955B2

(12) United States Patent
Braun

(10) Patent No.: US 9,290,955 B2
(45) Date of Patent: Mar. 22, 2016

(54) WORKING DEVICE WITH STATIONARY MAST AND ROTARY HEAD

(71) Applicant: Putzmeister Engineering GmbH, Aichtal (DE)

(72) Inventor: Matthias Braun, Stuttgart (DE)

(73) Assignee: Putzmeister Engineering GmbH, Aichtal (DE)

( * ) Notice: Subject to any disclaimer, the term of this patent is extended or adjusted under 35 U.S.C. 154(b) by 0 days.

(21) Appl. No.: 14/768,278

(22) PCT Filed: Feb. 27, 2014

(86) PCT No.: PCT/EP2014/053792
§ 371 (c)(1),
(2) Date: Aug. 17, 2015

(87) PCT Pub. No.: WO2014/135426
PCT Pub. Date: Sep. 12, 2014

(65) Prior Publication Data

US 2016/0002937 A1 Jan. 7, 2016

(30) Foreign Application Priority Data

Mar. 7, 2013 (DE) ..... 10 2013 203 886

(51) Int. Cl.
*F16L 3/00* (2006.01)
*E04G 21/04* (2006.01)

(52) U.S. Cl.
CPC ..... *E04G 21/0427* (2013.01); *E04G 21/0445* (2013.01)

(58) Field of Classification Search
USPC ..... 248/49
See application file for complete search history.

(56) References Cited

U.S. PATENT DOCUMENTS 3,367,280 A 2/1968 Bennett et al.
3,608,712 A 9/1971 Savoie (Continued)

FOREIGN PATENT DOCUMENTS

CN 202248914 U 5/2012
DE 1 781 099 A 10/1970

(Continued)

OTHER PUBLICATIONS

International Search Report of PCT/EP2014/053792, mailed May 8, 2014.

(Continued)

*Primary Examiner* — Monica Millner
(74) *Attorney, Agent, or Firm* — Collard & Roe, P.C.

(57) ABSTRACT

A working device has a base designed as a stationary support column, a motor-driven rotary head and a stack of arms made up of several mast arms which can be moved with respect to each other in pairs, using articulated or sliding joints, supporting a concrete transport line. The stack of arms is articulated on the rotary head about a horizontal rotational axis by a first mast arm. The working device also includes a control mechanism which can be actuated by a control element or a radio path and which is arranged in a control box, and a hydraulic assembly including an oil tank and a motor-driven hydraulic pump for controlling working groups for moving the rotary head and mast arm. A working platform fixed with respect to the frame is arranged in the region of the bearing block for emergency operations. In order to ensure that the components required for actuating the stack of arms are not in the way of the engine in the event of an emergency operation, the oil tank of the hydraulic assembly is arranged on the rotary head and includes a contour which is geometrically adapted to the rotary head, defining a window opening for the passage of a ballast boom which is detachably arranged on the rotary head. The oil tank also includes a holder for receiving the control cabinet which can pivot about at least 90° with respect to the window opening about an axis parallel to the rotational axis of the rotary head.

11 Claims, 6 Drawing Sheets

(56) References Cited

U.S. PATENT DOCUMENTS

Figure 1:
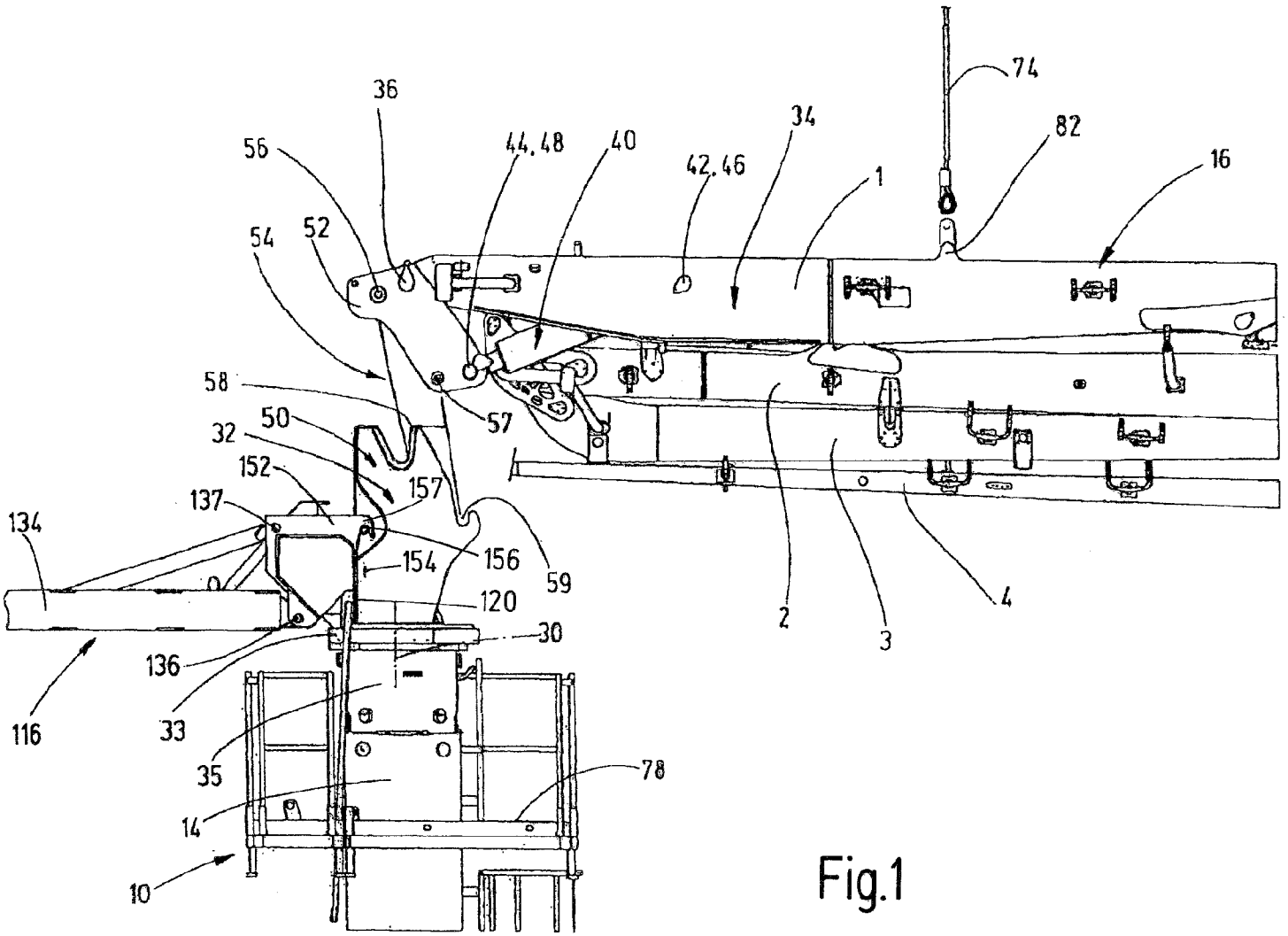

| | | | | | |
|---|---|---|---|---|---|
| 4,180,170 | A * | 12/1979 | Meinken | B66C 23/18 | 137/615 |
| 4,505,397 | A * | 3/1985 | Isogai | B66C 23/18 | 137/615 |
| 4,582,205 | A * | 4/1986 | Berger | B66C 13/52 | 212/175 |
| 5,393,193 | A * | 2/1995 | Dagg | B60P 1/5433 | 188/72.8 |
| 5,807,059 | A * | 9/1998 | Takeda | E04G 21/04 | 198/317 |
| 6,226,955 | B1 | 5/2001 | Lorrigan | | |
| 6,475,058 | B2 * | 11/2002 | Mammano | A63H 33/3044 | 446/425 |
| 6,675,822 | B1 | 1/2004 | Schmitz et al. | | |
| 7,258,242 | B2 * | 8/2007 | Irsch | B66C 13/18 | 212/168 |
| 7,631,659 | B2 | 12/2009 | Schneider et al. | | |
| 7,748,193 | B2 * | 7/2010 | Knigge | B66C 23/286 | 212/176 |
| 8,109,291 | B2 * | 2/2012 | Fuegel | B66C 23/32 | 137/615 |
| 2005/0271522 | A1 * | 12/2005 | Leibbrand | B60P 3/16 | 417/234 |
| 2006/0137750 | A1 * | 6/2006 | Alwes | B66C 23/42 | 137/615 |
| 2007/0175849 | A1 * | 8/2007 | Yokoyama | B66C 23/82 | 212/180 |
| 2011/0196583 | A1 * | 8/2011 | Petzold | B66C 23/78 | 701/50 |

FOREIGN PATENT DOCUMENTS

| | | | |
|---|---|---|---|
| DE | 33 11 736 | A1 | 10/1984 |
| DE | 44 14 567 | A1 | 11/1995 |
| DE | 295 21 389 | A1 | 2/1997 |
| DE | 100 49 927 | A1 | 4/2002 |
| EP | 1 235 965 | B1 | 9/2004 |
| JP | 2008-202232 | A | 9/2008 |
| WO | 86/00279 | A1 | 1/1986 |
| WO | 2008/055282 | A1 | 5/2008 |

OTHER PUBLICATIONS

German Search Report in DE 10 2013 203 886.0, dated Dec. 16, 2013, with English translation of relevant parts.

* cited by examiner

WORKING DEVICE WITH STATIONARY MAST AND ROTARY HEAD

CROSS REFERENCE TO RELATED APPLICATIONS

This application is the National Stage of PCT/EP2014/053792 filed on Feb. 27, 2014, which claims priority under 35 U.S.C. §119 of German Application No. 10 2013 203 886.0 filed on Mar. 7, 2013, the disclosure of which is incorporated by reference. The international application under PCT article 21(2) was not published in English.

The invention relates to a working device having a frame configured preferably as a stationary support column, having a motor-driven rotary head which is arranged on a bearing block, fixed to the frame, so as to be rotatable about a vertical rotation axis, having an arm assembly consisting of a plurality of boom arms that are movable in pairs relative to one another at articulated joints or sliding joints and carry a concrete delivery line, which arm assembly is articulated on the rotary head about a horizontal rotation axis by way of its first boom arm, having a control mechanism that is actuable either via control members or a radio link and has a hydraulic assembly for controlling drive units for the rotary-head and boom-arm movement, and having a working platform arranged in a manner fixed to the frame in the vicinity of the bearing block.

Working devices of this kind that are configured as concrete pumps have a distributor boom as outrigger, which carries a concrete delivery line that is connected to the pressure connector of a core pump arranged in a manner fixed to the frame. Such a working device having the features specified at the beginning is known per se (EP-1 235 965 B1). Therein, the components that belong to the drive mechanism of the rotary head are integrated into the bearing block fixed to the frame. A considerable disadvantage of this construction is that the working platform is constricted by the parts attached to the bearing block and therefore there is not enough space for the fitter to move. In addition, the hose assembly necessary for hydraulically controlling the arm assembly is relatively large and bulky and further restricts the space for the fitter to move at the point in question.

In the event of emergency operation, in which the fitter is active on the working platform, there is a not inconsiderable risk of injury if the rotary head with the arm assembly is controlled incorrectly. Depending on the boom position, in the event of emergency operation, the view of the fitter to the arm assembly is also impeded. Because of the relatively great height, on account of the fixtures, of the bearing block, safe operation from the working platform is not always ensured.

Taking this as a departure point, the invention is based on the problem of improving the known working device such that the fixtures necessary for the actuation of the arm assembly do not impede the fitter in the event of emergency operation.

In order to solve this problem, the combination of features specified in claim 1 is proposed. Advantageous configurations and developments of the invention can be gathered from the dependent claims.

The solution according to the invention consists substantially in that a liquid tank, which is expediently configured as an oil tank for the hydraulic assembly and has an external contour that is geometrically matched to the rotary head, is arranged on the rotary head above the bearing block. The liquid tank can in this case have a window bounded by its external contour, said window being intended for example for the passage of a ballast outrigger arranged releasably on the rotary head. Furthermore, a holder for receiving the control cabinet can be arranged on the liquid tank, said holder being pivotable through at least 90° about an axis parallel to the rotation axis of the rotary head with respect to the window. As a result of this measure, the holder with the control cabinet can be pivoted into the window when a ballast outrigger is not present or can be pivoted out of said window parallel to a ballast outrigger that is present. The working platform free of fixtures allows the fitter to move around without stumbling and to have a good view of the arm assembly. As a result of the omission of the disruptive fixtures, the arm assembly can be placed close to the rotary head, with the result that the load torque produced thereby is reduced.

A preferred configuration of the invention provides for the rotary head to have a base part arranged on the bearing block and an adapter piece comprising a bearing point for the ballast outrigger, wherein the base part and the adapter piece are coupled together releasably via a separation point. In this case, the base part and the adapter piece expediently have coupling elements that are connectable together in a form-fitting manner in pairs at their separation point. In order to be able to lead the ballast outrigger to the separation point, the window arranged on the oil tank has to be free by pivoting out the control cabinet located on the holder.

According to an advantageous development of the invention, the arm assembly, too, is coupled releasably to the base part of the rotary head by means of further coupling elements that are connectable together in a form-fitting manner in pairs via a further adapter piece at a second separation point located opposite the separation point of the ballast outrigger. In this way, it is possible for the arm assembly, together with the further adapter piece, to be able to be separated from the base part of the rotary head in the region of the second separation point, while the base part, together with the bearing block, remains on the frame. It is particularly advantageous in this case for the base part and the adapter piece to have coupling elements that are connectable together in a form-fitting manner in pairs in the region of the second separation point.

Figure 2A:
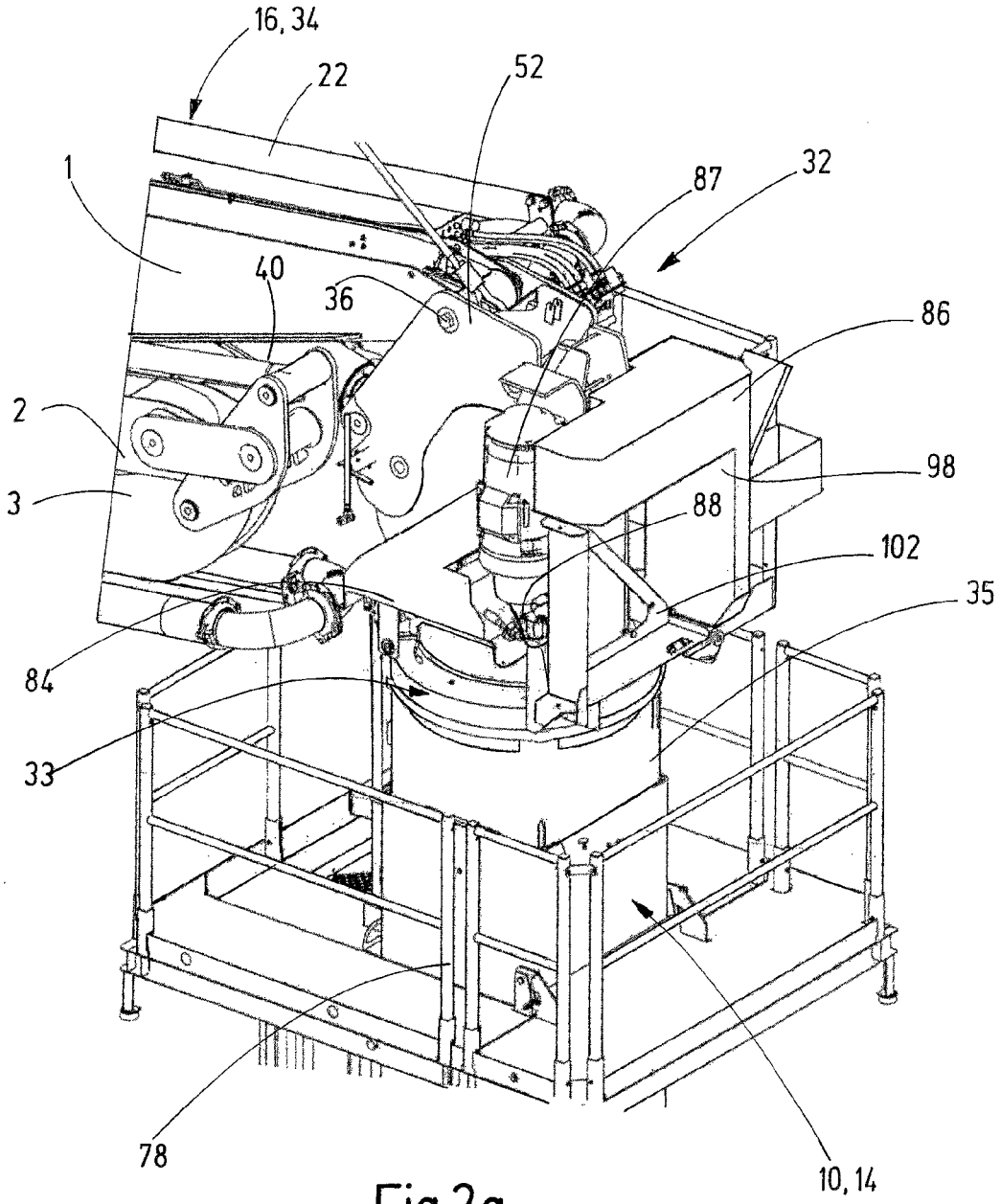
Figure 4:
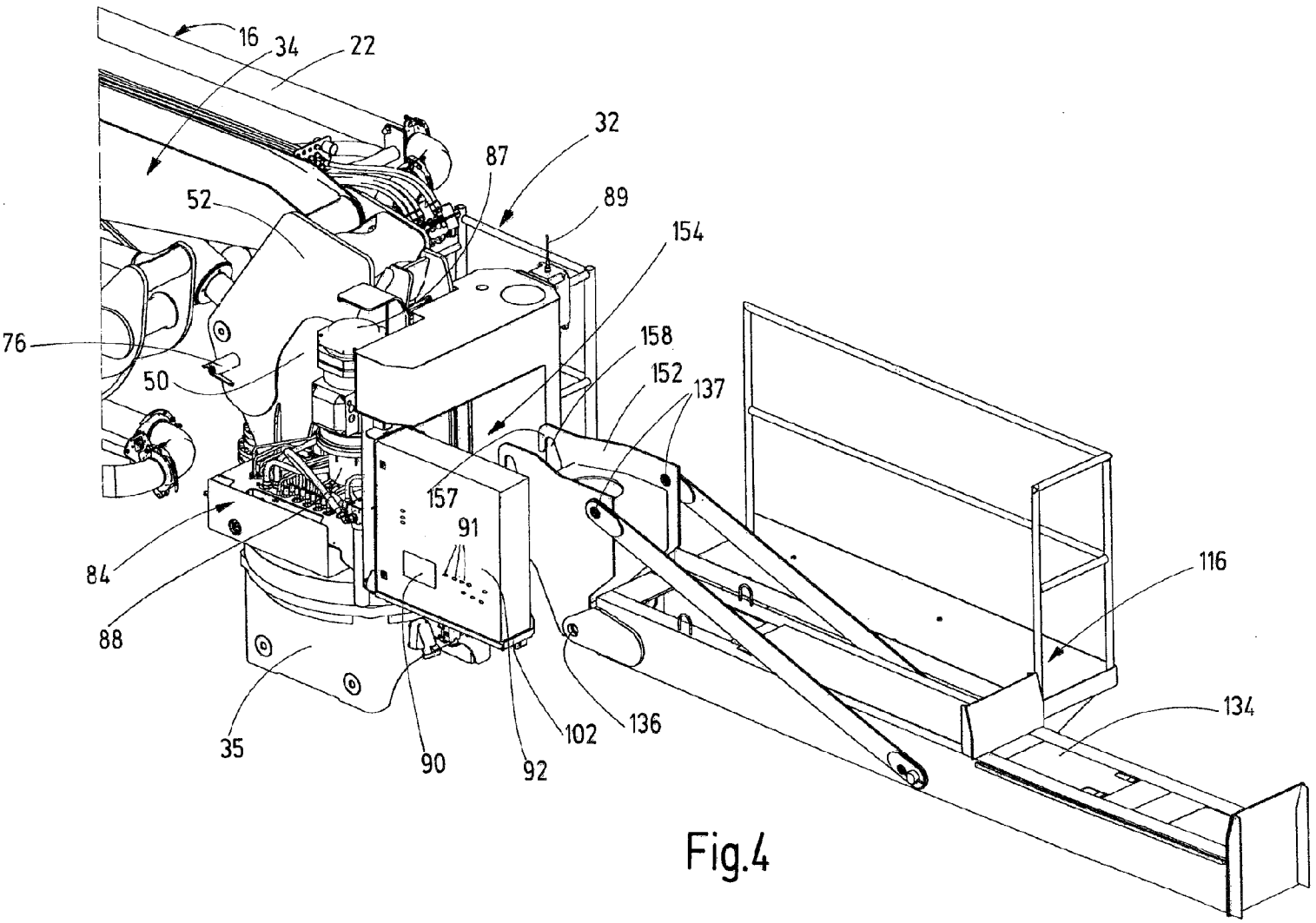

The invention is explained in more detail in the following text with reference to an exemplary embodiment which is schematically illustrated in the drawing, in which:

FIG. 1 shows an exploded illustration of a detail of a working device, configured as a concrete distributor boom, having a support column, arm assembly and ballast outrigger;

FIGS. 2*a, b* and *c* show a diagrammatic illustration and two side views of a detail of the working device with fixtures on the rotary head;

FIG. 3*a* to *d* show four different diagrammatic illustrations of the rotary head with fixtures, mounted on the bearing block;

FIG. 4 shows a diagrammatic illustration of the rotary head with bearing block, arm assembly and ballast outrigger.

The working device illustrated in the drawing is configured as a concrete pump having a stationary frame 10. The frame 10 forms a support column, which has at its upper end a substructure 14 with a bearing block 35 for a rotary head 32 that is rotatable about a vertical rotation axis 30. Arranged on the rotary head 32 are respective outriggers 16, 116 that are directed toward opposite sides of the support column and are configured as an arm assembly 34 and as a ballast carrier 134. The arm assembly 34 has a plurality of boom arms 1, 2, 3, 4 that are pivotable with respect to one another in pairs and carry a concrete delivery line 22. As can be seen in particular in FIGS. 1 and 4, the outrigger 16 with the first boom arm 1 of the arm assembly 34 is mounted in a pivotable manner about a horizontal pivot axis in the mounted state at a bearing point 36 of the rotary head 32. In order to be able to pivot the outrigger 16 with respect to the rotary head 32, provision is furthermore made of a hydraulic cylinder-piston unit 40 configured as a double-acting hydraulic cylinder, which is articulated with its end 42 fixed to the cylinder and with its end 44 fixed to the piston rod to an outrigger-side articulation point 46 arranged at a distance from the bearing point 36 and to a rotary-head-side articulation point 48 with a horizontal articulation axis, respectively.

The outrigger 16 configured as an arm assembly 34 of a concrete distributor boom is releasably coupled to the base part 50 of the rotary head 32 by means of coupling elements that are connectable together in a form-fitting manner in pairs via an adapter piece 52 at a separation point 54. For this purpose, the adapter piece 52 has coupling elements configured as pin-like drop-in elements 56, 57, while the base part 50 is provided with receptacles 58, 59, peripherally open upwardly, for the drop-in elements 56, 57. The bores, discernible in FIG. 1, in the adapter piece 52 form the bearing point 36 for the outrigger 16 and the rotary-head-side articulation point 48 for the cylinder-piston unit 40.

The outrigger 16 is transported to the frame 10 with the aid of a crane, which is fixed to the outrigger 16 at the centroid position 82 thereof via a crane gear 74. As can be seen from FIG. 4, provision is additionally made, in the region of the separation point 54, of a security device which is produced by means of a socket pin or latching pin 76 between the adapter piece 52 and the base part 50. The socket pin or latching pin 76 can be fitted subsequently by a fitter from a working platform 78 fixed to the substructure (FIG. 1).

It can be seen in FIGS. 1 and 4 that the rotary head 32 has, in addition to the base part 50 arranged on the bearing block 35, a second adapter piece 152 comprising a bearing point 136 for an additional outrigger 116. The additional outrigger 116, having a ballast carrier 134, is releasably coupled to the base part 50 of the rotary head 32 by means of coupling elements that are connectable together in a form-fitting manner in pairs via the adapter piece 152 at the separation point 154. In this case, a first group of coupling elements is configured as pin-like drop-in members 156 and a second group of coupling elements is configured as hooking members 157 provided with a peripherally open receptacle 158 for the drop-in members 156. The drop-in members 156 are arranged on the base part 50, while the hooking members 157 with a receptacle 158 that is peripherally open downwardly are arranged on the adapter piece 152. The adapter piece 152 has a stop 120 that is arranged beneath the peripherally open receptacle 158 in the mounted state and bears against the base part 50 under the action of the load torque generated about the axis of the drop-in members 156 via the outrigger 116. In the exemplary embodiment shown, the adapter piece 152 is connected to the outrigger 116 at two bearing points 136, 137, wherein the bearing points 136, 137 are spaced apart from one another primarily in the vertical direction. In a similar manner to the outrigger 16, the outrigger 116 can also be mounted on the base part 50 by means of a crane.

Figure 2B:
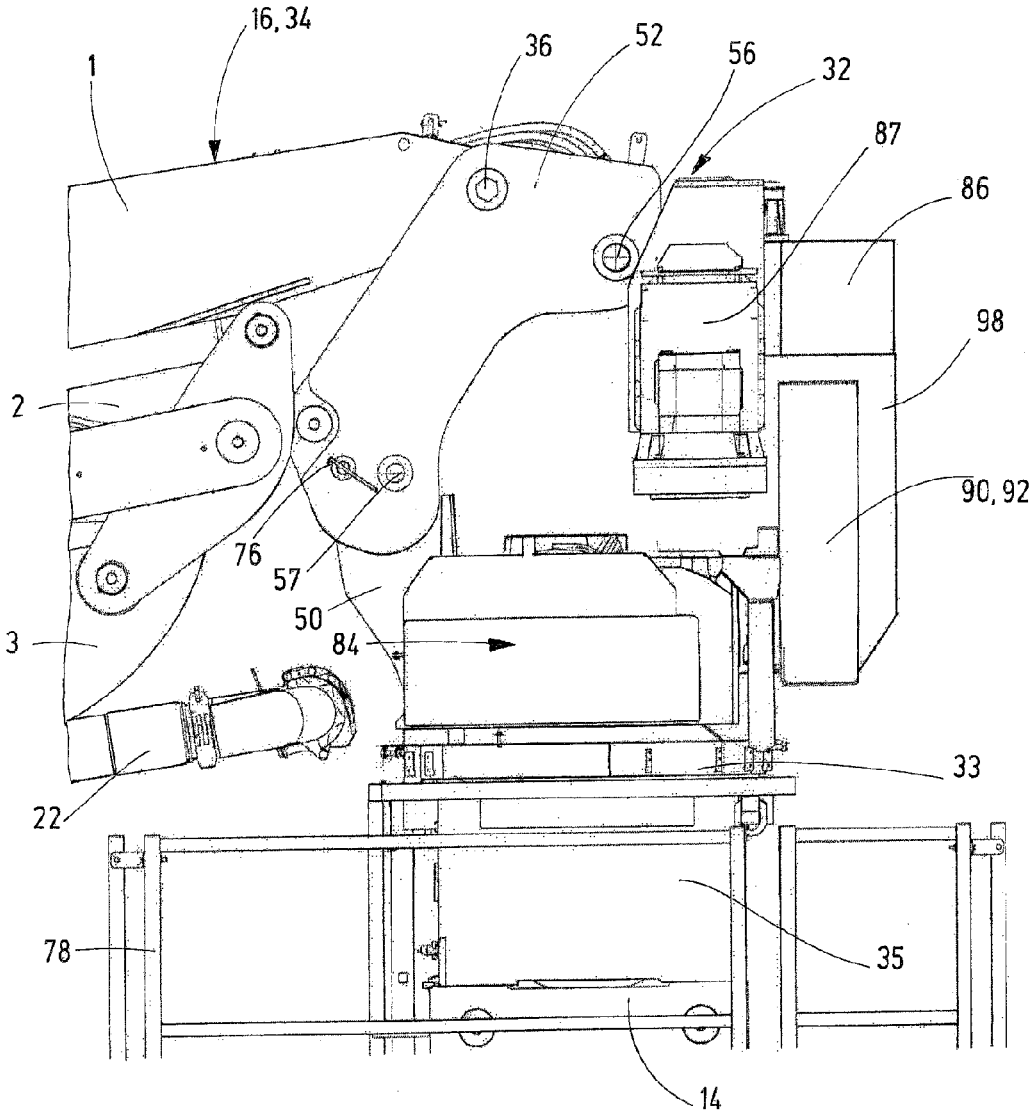
Figure 2C:
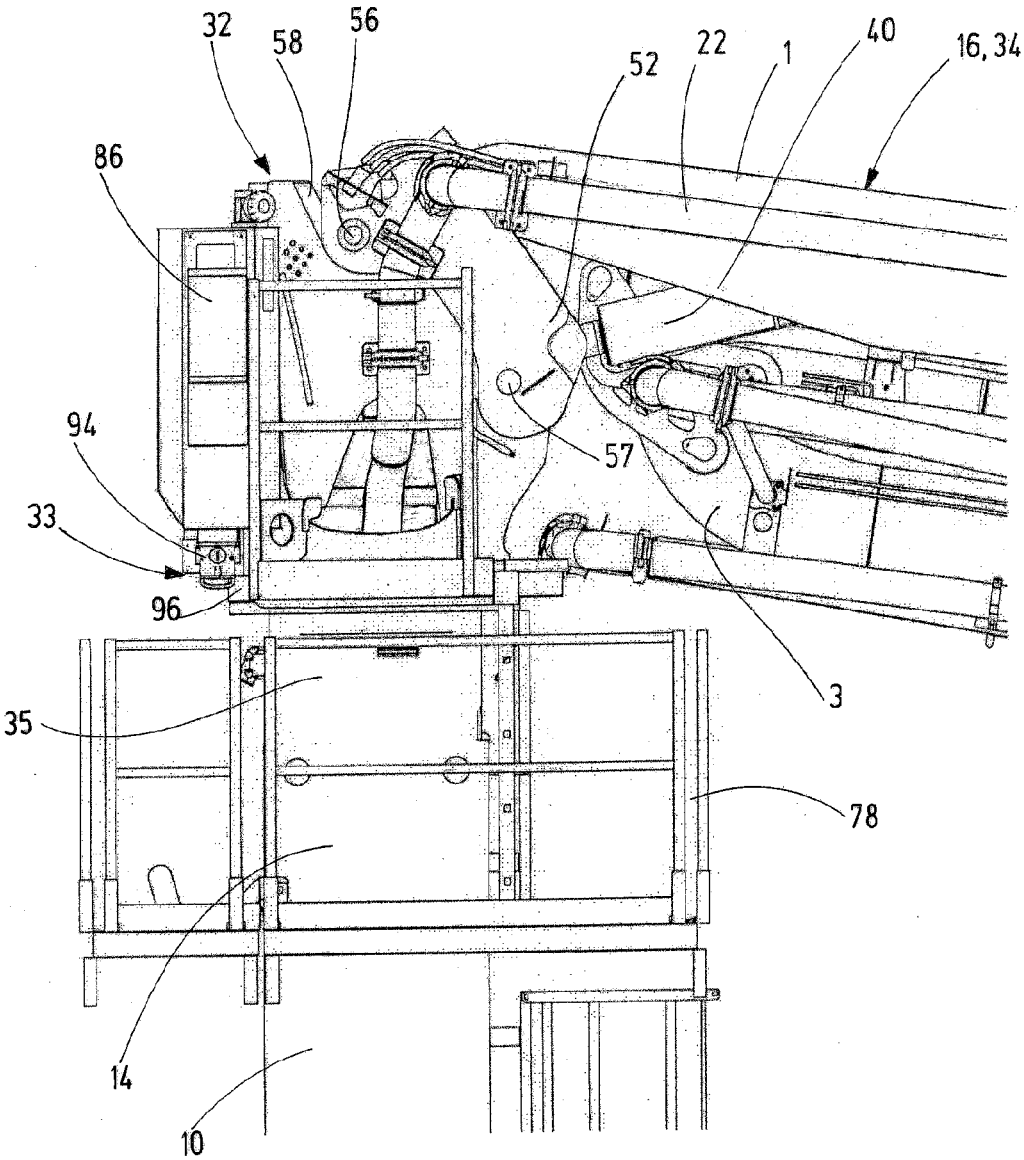
Figure 3B:
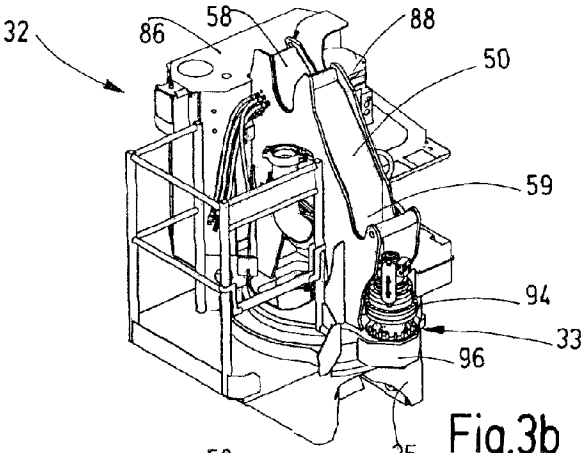
Figure 3D:
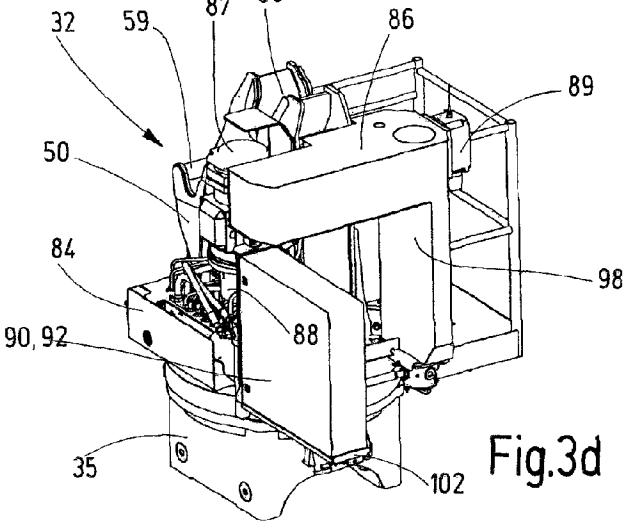
Figure 3A:
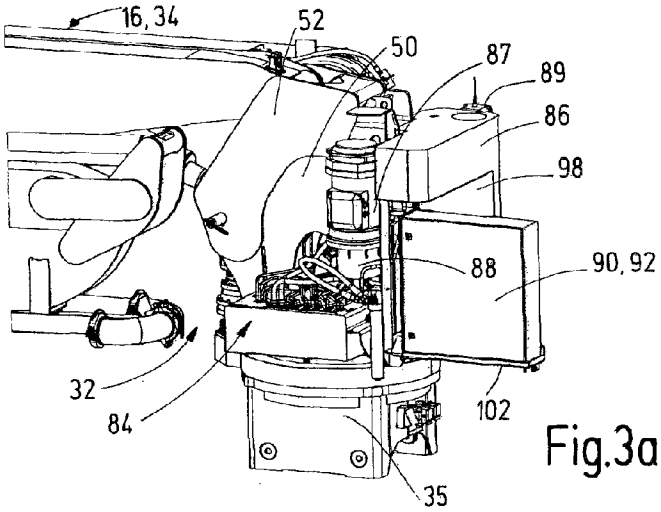
Figure 3C:
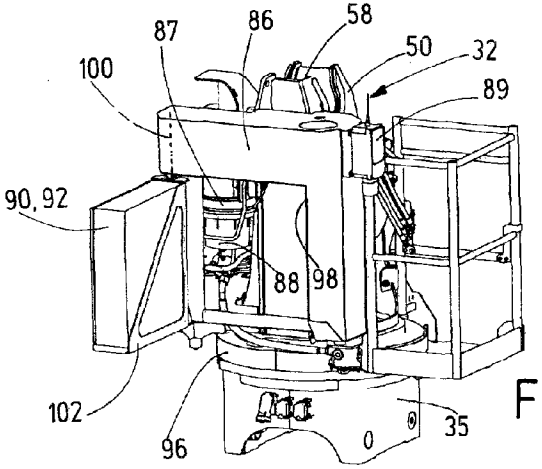

As can be seen from FIGS. 2 to 4, the rotary head is equipped with a relatively large number of fixtures, which have the following functions:

- A hydraulic assembly 84 for controlling drive units for the rotary-head and boom-arm movement, said hydraulic assembly 84 having an oil tank 86 and a hydraulic pump 88 driven by means of an electric motor 87,
- a control mechanism 90 which is actuable either via control members 91 or a radio link 89 and is accommodated in a control cabinet 92,
- a drive mechanism 33 which has a hydraulic drive motor 94 and a slewing gearbox 96 for driving the rotary head 32 in rotation with respect to the bearing block 35,
- and a working platform 78 arranged in a manner fixed to the frame close to the bearing block 35.

One particular feature of the invention is that the oil tank 86 has an external and internal contour that is geometrically matched to the rotary head 32. As can be seen in particular from FIGS. 3*a* to *d* and 4, the oil tank 86 is provided with a window 98 which is intended for the passage of a ballast outrigger 134 mounted on the rotary head 32. However, the ballast outrigger 134 only has to be provided when the frame 10 is loaded so heavily on account of the load torque acting on the rotary head 32 via the arm assembly 34 that load balancing is required. When a ballast outrigger 134 is not provided, the window 98 can be used to receive the control cabinet 92 for the control mechanism 90. In order to be ready for both cases, provision is made on the oil tank 86 of a holder 102 for receiving the control cabinet 92, said holder 102 being pivotable about an axis 100 parallel to the rotation axis 30 of the rotary head 32 with respect to the window 98. In this way it is possible, when the ballast outrigger 134 is present, to pivot the control cabinet 92 out of the window 98 via its holder 102, such that it can be operated from the working platform 78.

A further particular feature of the invention is that the control cabinet 92 with the control mechanism 90 and the hydraulic assembly 84 with the oil tank 86 and hydraulic pump 88 are arranged on the base part 50 of the rotary head 32 above the bearing block 35. Likewise arranged on the rotary head 32 above the bearing block 35 is the hydraulic drive motor 94 together with the slewing gearbox 96 for driving the rotary head 32. The control mechanism 90 is supplied with electric power via an external power source and an electrical cable that is routed via the support column fixed to the frame and bridges the rotary bearing between the bearing block 35 and rotary head 32.

With the construction according to the invention, as a result of which the operationally necessary fixtures, such as the control cabinet 92, hydraulic assembly 88 and drive mechanism 33, are arranged directly on the rotary head 32 above the bearing block 35, the freedom of movement of the fitter in the region of the working platform 78 is improved. The working platform 78 free of fixtures allows the fitter to move around without stumbling when rotating the rotary head 32 and also allows a good view of the arm assembly 34. As a result of the omission of the disruptive fixtures, the arm assembly 34 can furthermore be placed close to the rotary head 32, with the result that the load torque generated thereby and thus the deflection of the frame 10 can be reduced.

In summary: the invention relates to a working device having a frame 10 configured as a stationary support column, having a motor-driven rotary head 32 and having an arm assembly 34 consisting of a plurality of boom arms 1, 2, 3, 4 that are movable in pairs relative to one another at articulated joints or sliding joints and carry a concrete delivery line. The arm assembly 34 is articulated on the rotary head 32 about a horizontal rotation axis with its first boom arm 1. Provision is furthermore made of a control mechanism 90 that is actuable via control members or a radio link and is arranged in a control cabinet 92, and a hydraulic assembly 84, having an oil tank 86 and a motor-driven hydraulic pump 88, for controlling drive units for the rotary-head and boom-arm movement. For emergency operation, a working platform 78 arranged in a manner fixed to the frame is located in the vicinity of the bearing block 35. In order to ensure that the fixtures necessary for actuating the arm assembly 34 do not disrupt the operator in the event of emergency operation, the invention proposes that the oil tank 86 of the hydraulic assembly 84 is arranged on the rotary head 32 and has a contour that is geometrically matched to the rotary head 32 and bounds a window 98 for the passage of a ballast outrigger 116, 134 arranged releasably on the rotary head 32. Furthermore, a holder 102 for receiving the control cabinet 92 is arranged on the oil tank 86, said holder 102 being pivotable through at least 90° about an axis 100 parallel to the rotation axis 30 of the rotary head 32 with respect to the window 98.

LIST OF REFERENCE SIGNS

1, 2, 3, 4 Boom arms
10 Frame
14 Substructure
16 Outrigger
22 Concrete delivery line
30 Rotation axis
32 Rotary head
33 Drive mechanism
34 Arm assembly
35 Bearing block
36 Bearing point
40 Cylinder-piston unit
42 End fixed to the cylinder
44 End fixed to the piston rod
46, 48 Articulation points
50 Base part
52 Adapter piece
54 Separation point
56, 57 Drop-in elements
58, 59 Receptacles
74 Crane gear
76 Latching pin
78 Working platform
82 Centroid position
84 Hydraulic assembly
86 Oil tank
87 Electric motor
88 Hydraulic pump
89 Radio link
90 Control mechanism
91 Control members
92 Control cabinet
94 Drive motor
96 Slewing gearbox
98 Window
100 Axis
102 Holder
116 Outrigger
134 Ballast outrigger
136, 137 Bearing points
152 Adapter piece
154 Separation point
156 Drop-in member
157 Hooking member
158 Receptacles

The invention claimed is:

1. A working device having a frame (10) configured preferably as a stationary support column, having a motor-driven rotary head (32) which is arranged on a bearing block (35), fixed to the frame, so as to be rotatable about a vertical rotation axis (30), having an arm assembly (34) comprising a plurality of boom arms (1, 2, 3, 4) that are movable in pairs relative to one another at articulated joints or sliding joints and carry a concrete delivery line (22), which arm assembly (34) is articulated on the rotary head (32) about a horizontal rotation axis with its first boom arm (1), and having a control mechanism that is actuable either via control members (91) or a radio link (89) and has a hydraulic assembly (84) for controlling drive units for the rotary-head and boom-arm movement, wherein a liquid tank which has an external contour that is geometrically matched to the rotary head (32) is arranged on the rotary head (32), and wherein the liquid tank bounds a window with its external contour.

2. The working device as claimed in claim 1, wherein a ballast outrigger (134) that reaches through the window (98) is releasably arranged on the rotary head (32).

3. The working device as claimed in claim 1, wherein the window is configured as a reach-through opening for assembly and disassembly work.

4. The working device as claimed in claim 1, wherein a liquid tank which has an external contour that is geometrically matched to the rotary head (38) is arranged on the rotary head (32), said liquid tank being provided with a window (98) for the passage of a ballast outrigger mounted on the rotary head (32) and/or to be reached through for assembly and disassembly work.

5. The working device as claimed in claim 1, wherein the liquid tank (86) is configured as an oil tank for the hydraulic assembly (84).

6. The working device as claimed in claim 1, wherein the control mechanism (90) is arranged in a control cabinet (92), and wherein the liquid tank has a holder for receiving the control cabinet.

7. The working device as claimed in claim 6, wherein the holder with the control cabinet (92) is pivotable through at least 90° about an axis (100) parallel to the rotation axis (30) of the rotary head (32) with respect to the window (98).

8. The working device as claimed in claim 2, wherein the rotary head (32) has a base part (50) arranged on the bearing block (35) and an adapter piece (152) comprising a bearing point (136, 137) for the ballast outrigger (134), wherein the base part (50) and the adapter piece (152) are coupled together releasably via a separation point (154).

9. The working device as claimed in claim 8, wherein the base part (50) and the adapter piece (152) have coupling elements that are connectable together in a form-fitting manner in pairs at their separation point (154).

10. The working device as claimed in claim 1, wherein the arm assembly (34) is coupled releasably to the base part (50) of the rotary head (32) by means of coupling elements that are connectable together in a form-fitting manner in pairs via an adapter piece (52) at a separation point (54).

11. The working device as claimed in claim 1, further comprising a working platform (78) arranged in a manner fixed to the frame in the vicinity of the bearing block (35).

* * * * *